United States Patent [19]

Benoist et al.

[11] Patent Number: 4,592,200

[45] Date of Patent: Jun. 3, 1986

[54] TURBO-JET ENGINE AFTERBURNER SYSTEM

[75] Inventors: René A. Benoist, Le Mee sur Seine; Michel R. Clauzel, Varennes-Jarcy; Roger A. J. Vandenbroucke, Antony, all of France

[73] Assignee: Societe Nationale d'Etude et de Construction de Moteurs d'Aviation - S.N.E.C.M.A., Paris, France

[21] Appl. No.: 647,398

[22] Filed: Sep. 5, 1984

[30] Foreign Application Priority Data

Sep. 7, 1983 [FR] France ..... 83 14249

[51] Int. Cl.[4] ..... F02K 3/10; F02C 1/00

[52] U.S. Cl. ..... 60/261; 60/749

[58] Field of Search ..... 60/261, 749, 263, 241, 60/264

[56] References Cited

U.S. PATENT DOCUMENTS

| | | | |
|---|---|---|---|
| 2,799,991 | 7/1957 | Conrad | 60/261 X |
| 2,875,580 | 3/1959 | Moy et al. | 60/261 X |
| 3,102,392 | 9/1963 | Bauger et al. | 60/261 |
| 3,151,453 | 10/1964 | Lefebvre et al. | 60/261 |
| 3,540,216 | 11/1970 | Quillevere et al. | 60/261 X |
| 3,587,232 | 6/1971 | Bryce | 60/261 X |
| 3,698,186 | 10/1972 | Beane et al. | 60/261 X |
| 3,765,178 | 10/1973 | Hufnagel et al. | 60/261 |
| 3,910,038 | 10/1975 | Bourdereau et al. | 60/261 |
| 3,931,707 | 1/1976 | Vdoviak | 60/261 |
| 4,125,998 | 11/1978 | Barou et al. | 60/261 |
| 4,280,324 | 7/1981 | Arliguie et al. | 60/261 |

FOREIGN PATENT DOCUMENTS

| | | | |
|---|---|---|---|
| 1245920 | 10/1960 | France . | |
| 2186608 | 1/1974 | France . | |
| 2090250 | 1/1974 | France . | |
| 1255648 | 12/1971 | United Kingdom | 60/261 |

*Primary Examiner*—Carlton R. Croyle
*Assistant Examiner*—Timothy S. Thorpe
*Attorney, Agent, or Firm*—Oblon, Fisher, Spivak, McClelland & Maier

[57] ABSTRACT

An annular burner has an annular flame stabilizer of substantially V shaped cross-section containing a circular fuel injection manifold discharging in counterflow. The annular flame stabilizer is formed by two independent parts, each of these parts constituting one blade of the V cross-section. Pivotal support means are provided at the end of the separation wall of the flows in order to mount each of the parts of the annular stabilizer. The injection manifold is secured to the outer blade of the ring.

5 Claims, 4 Drawing Figures

TURBO-JET ENGINE AFTERBURNER SYSTEM

BACKGROUND OF THE INVENTION

1. Field of the Invention

The invention relates to an annular burner for an afterburner of a jet engine, for example for a reheat system of a bypass turbofan engine.

2. Summary of the Prior Art

Certain military multi-flow engines, equipped with a reheat system in the two flows, may comprise one or more annular burners serving strictly for postcombustion for heating of the secondary flow. Generally one of the afterburner rings is disposed at the conjunction of the two flows, just to the rear of the conical wall separating them.

The annular burner comprises an annular flame stabilizer of V-shaped cross-section containing a circular manifold for the injection of fuel discharging in counter flow through openings provided at the apex of the V cross-section.

As a result of the position of the annular stabilizer, its blades are subject to very different temperatures. The external blade is subjected to the flow of secondary air of which the temperature will not exceed 200° C. whilst the internal blade is subject to a temperature of gases leaving the turbine, of the order of 850° C.

Such differences in temperature give rise to varying high stresses and to strains in the annulus which are prejudicial to its successful operation and to its mechanical integrity.

French Patent Specification No. 2 186 608 proposes a solution to this reheat problem by disposing at a predetermined distance upstream of the annular burner an annular member termed an anvil, against which the jets emitted by the holes provided in the manifold are atomized. The mixture of gas and fuel produced and then atomized, passes through openings surrounding the jets and provided in the annular stabilizer, into the space surrounding the manifold in the annulus and protects the latter from the heat of the flame. Furthermore, the sheets of mist are uniformly charged with atomized fuel and dampen the external surface of the annular stabilizer which avoids hot spots and consequent excessive deformation.

The device described in this prior specification does not enable the avoidance of stresses in the annulus, which unfavourably influences the mechanical integrity. The principle aim of the anvil is the production of a uniform atomization of the fuel in the air flow and improved flame stability.

SUMMARY OF THE INVENTION

According to the present invention there is provided an annular burner for an afterburner in a bypass turbofan engine with two separated flows having a separation wall of the two flows, comprising an annular flame stabilizer having a cross-section approximating a V and comprising two independent parts, each of these parts constituting one limb of the stabilizer which, at the apex of the V cross-section define a slot, an annular fuel injection manifold within the stabilizer and arranged to discharge fuel in a upstream direction in counterflow with respect to the normal flow of gases in the engine through said slot of the stabilizer, pivotal support means provided at the end of said separation wall whereby to mount each of the parts of the annular stabilizer.

DESCRIPTION OF THE PREFERRED EMBODIMENT

Figure 1:
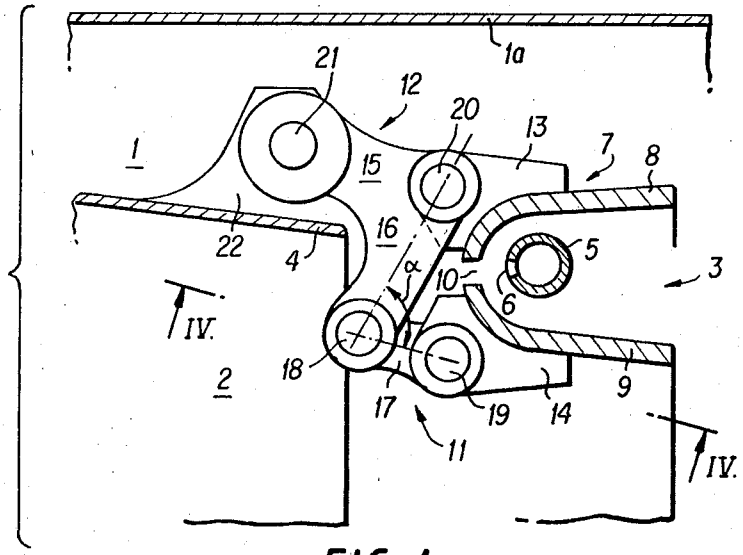
FIG. 1 illustrates a longitudinal partial section of an annular burner in accordance with the invention.

FIG. 1 is a view in partial longitudinal section of a part of a bypass turbofan engine disposed at the outlet of the secondary flow duct 1 and the end of the primary flow duct 2. The annular burner 3 is mounted at the confluence of the two flows, just to the rear of a conical wall 4 separating them and on which it is secured. An external wall 1*a* forms the boundary of the secondary flow duct 1.

The annular burner 3 comprises an injection manifold 5, provided with orifices 6 for the injection of fuel, in contraflow with the primary and secondary air flows, an annular flame stabilizer 7 being disposed upstream of the manifold and enclosing the latter. In known manner, the annular stabilizer has a cross-section approximating a V, section, the apex of the V cross-section being directed upstream of the flow. The cross-section can also be considered to resemble a "U".

According to the embodiment illustrated, the annular stabilizer is formed by two independent parts, outer and inner limbs 8 and 9, respectively, each of these parts constituting one limb of the V cross-section. The two adjacent ends of the limbs define between them an annular continuous slot 10 enabling the passage of the jets of fuel emitted by the manifold 5.

The annular burner 3 is mounted on the conical separation wall 4 of the flows by pivotal support means 11.

The outer limb 8 and inner limb 9 are suspended on the conical wall 4 by bell crank levers 12, through the intermediary of clevises 13 and 14 welded to respective limbs 8 and 9, and disposed in the same axial planes and uniformly distributed along the limbs.

Figure 4:
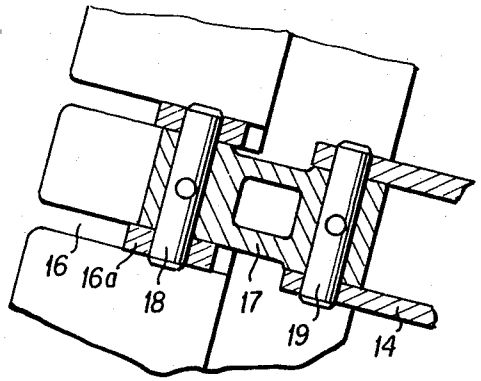
FIG. 4 is a section on the line IV—IV of FIG. 1.

The bell-crank levers 12 each have two arms 15 and 16 of unequal lengths. The shorter arm 16 terminates at a clevis 16*a* which co-operates through the intermediary of a link 17 with a double clevis 14 of the inner limb 9, the link 17 being pivoted to the double clevises 16*a* and 14 by two pins 18 and 19 (see also FIG. 4).

The elbow formed by the arms 15 and 16 comprises a bore which receives a pin 20 thus mounting in a pivotal manner the clevis 13 welded on the outer limb 8.

The free end of the longer arm 15 has a bore co-operating through the intermediary of a pin 21 with a clevis 22 secured to the outer surface of the wall 4.

The relative movements of the limbs 8 and 9 resulting from differential expansions, have no other effect than to open or to close to a greater or lesser extent the angle $\alpha$ defined by the straight lines 18, 19 and 18, 20 without putting the annulus under stress. Although the structure is free to pivot owing to the use of the pins 18,19,20 and 21, the actual movement is very small and is limited to movements dictated by thermal expansions and contractions.

Figure 2:
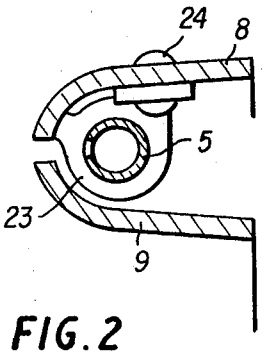
FIG. 2 is a longitudinal section of an annulus of the burner at a connection of an injection manifold.
Figure 3:
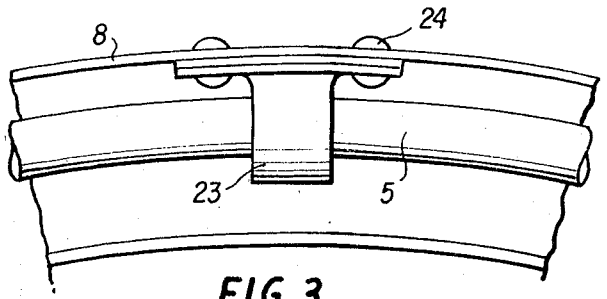
FIG. 3 is a fragmentary view of a jet engine showing the annular burner and the connection of the injection manifold.

In accordance with the detail of the embodiment illustrated in FIGS. 2 and 3, the injection manifold 5 is secured in place along the stabilizer 7 by tabs 23 and rivets 24 to the outer limb 8.

The outer limb 8, projecting into the secondary air flow at low temperature, has a thermal expansion which is small and its dimensional characteristics vary only to a small extent.

The injection manifold 5 is rigid therewith will not be subjected to displacement to a degree liable to modify the direction of the jets and will enable employment of a reasonable width of annular slot 10 in spite of the relatively high expansion of the inner limb 9.

The continuous slot 10 of the annular burner in accordance with the embodiment will possibly enable the use of an annular anvil such as described in French Patent Specification No. 2 186 608. The omission of the partitions separating the openings surrounding the jets such as described in the Patent referred to, prevents the formation of this relatively small zone and improves the passage for the mixture of gas and atomized fuel into the space surrounding the manifold 5 within the stabilizing annulus 7 and protects the manifold against the heat of the flame.

We claim:

1. An annular burner for an afterburner in a bypass turbofan engine with two separated flows, having a separation wall between said two flows, comprising:

an annular flame stabilizer having a cross-section approximating a V, said V cross-section being formed by two separate and independent parts which define a slot at the apex of the V cross-section, each of said parts constituting one limb of the stabilizer;

an annular fuel injection manifold within the stabilizer and arranged to discharge fuel through said slot of the stabilizer in a counterflow direction with respect to the normal flow of gases in the engine; and pivotal support means for mounting both said parts of said stabilizer for independent motion, said pivotal support means being mounted on said separation wall at the downstream end thereof.

2. An annular burner according to claim 7, wherein the pivotal support means comprise a bell crank lever pivotally secured by the end of one of its arms to said separation wall, the other arm pivotally supporting, through the intermediary of a link, an inner limb of the annular stabilizer, an outer limb of said stabilizer being pivotally secured to a middle zone of the bell crank lever.

3. An annular burner according to claim 2, wherein the limbs of the annular stabilizer are supported by a plurality of pairs of clevises distributed uniformly along the limbs, each said pair of clevises comprising a first clevis cooperating with said middle zone of said lever and a second clevis cooperating with one end of said link, said first and second clevis of each pair being approximately disposed in the same axial plane.

4. An annular burner according to claim 1, comprising securing means for the fuel manifold, the securing means being mounted on the radially outer one of the limbs of the stablizer.

5. An annular burner according to claim 4, wherein the securing means comprise tabs distributed along the said outer limb.

* * * * *